United States Patent [19]

Zapletal

[11] Patent Number: 4,730,358

[45] Date of Patent: Mar. 15, 1988

[54] SINUOUS SPRING MODULE BOX SPRING ASSEMBLY

[75] Inventor: Henry Zapletal, Carthage, Mo.

[73] Assignee: Leggett & Platt, Incorporated, Carthage, Mo.

[21] Appl. No.: 30,461

[22] Filed: Mar. 25, 1987

Related U.S. Application Data

[63] Continuation of Ser. No. 732,373, May 9, 1985, abandoned.

[51] Int. Cl.[4] ..... A47C 23/02

[52] U.S. Cl. ..... 5/247; 5/255; 5/464; 5/474

[58] Field of Search ..... 5/247, 248, 255, 256, 5/253, 260, 272, 273, 276, 464, 474, 475, 476; 267/103, 106, 107, 109

[56] References Cited

U.S. PATENT DOCUMENTS

| | | | |
|---|---|---|---|
| 2,105,115 | 1/1938 | Gleason | 5/260 |
| 2,116,402 | 5/1938 | Menge | 267/103 |
| 2,526,250 | 10/1950 | Matthaei, Jr. | 267/107 |
| 2,705,527 | 4/1955 | Flint et al. | 267/107 |
| 2,798,233 | 7/1957 | Robell | 297/96 |
| 2,826,768 | 3/1958 | Drews | 5/260 |
| 2,979,739 | 4/1961 | Krakauer | 5/476 |
| 3,325,831 | 6/1967 | Crosby et al. | 5/475 |
| 3,725,965 | 4/1973 | Smith et al. | 5/247 |
| 3,825,960 | 7/1974 | Inman et al. | 5/247 |
| 3,833,948 | 9/1974 | Surletta et al. | 5/247 |
| 3,835,485 | 9/1974 | Klicki | 5/247 |
| 3,990,121 | 11/1976 | Whitaker | 5/260 |
| 4,100,631 | 7/1978 | Slone | 5/247 |
| 4,555,097 | 11/1985 | Hiatt | 5/247 |

*Primary Examiner*—Alexander Grosz
*Assistant Examiner*—Michael F. Trettel
*Attorney, Agent, or Firm*—Wood, Herron & Evans

[57] ABSTRACT

A box spring assembly includes a base frame, a top wire grid and a plurality of sinuous wire springs interconnecting the top wire grid and the base frame. The sinuous wire springs each comprise a sinuous wire strip formed into a U-shaped configuration with the bottom of each U-shaped spring attached to the base frame and the free ends at the top of the U-shaped spring attached to the wire grid.

15 Claims, 4 Drawing Figures

6

SINUOUS SPRING MODULE BOX SPRING ASSEMBLY

This is a continuation, of application Ser. No. 732,373, filed May 9, 1985 now abandoned.

This invention relates to bedding foundations, and more particularly to a box spring style of bedding foundation.

Traditional prior art box spring assemblies have included coil springs positioned in a vertical orientation so as to provide resilient support for a bedding mattress. In an effort to improve upon these conventional coil spring types of box spring assemblies, numerous prior art assemblies have been developed which substituted formed wire springs for the more traditional coil springs. "Formed wire" springs is a term of art used to describe springs which derive their resiliency from torsion bars rather than coils. Examples of formed wire springs embodied in box spring assemblies are to be found in U. S. Pat. Nos. 3,825,960, 3,833,948 and 3,835,485. Additionally, some prior art box spring assemblies have been developed which included combinations of coil and formed wire springs, as for example the box spring assembly shown in U. S. Pat. No. 3,990,121. In those instances wherein formed wire springs and coil springs have been combined in a box spring, the formed wire springs have usually functioned to impart additional firmness to selected areas of the box spring, as for example around the edge of the box spring or in the center section of the box spring.

A common problem with all box springs which utilize formed wire springs is that those box springs are relatively expensive to manufacture, primarily because the equipment upon which the formed wire spring portions of the box spring are manufactured, are usually capable of making only one bend per stroke of a forming machine. Consequently, the formed wire springs, which generally have multiple bends formed therein, are expensive to produce and the resulting box spring is an expensive configuration of multiple formed wire springs.

It has therefore been an objective of this invention to provide an improved box spring which utilizes a novel formed wire spring to provide resilient support of the load supporting surface of the box spring, but which formed wire spring is relatively inexpensive to manufacture.

Still another objective of this invention has been to provide an improved box spring which has all of the resiliency and selective firmness characteristics of prior art box springs, but which may be manufactured and sold substantially less expensively.

The present invention is directed toward an improved box spring having relatively firm edge support but somewhat softer center support, or a box spring having relatively soft end sections and a firmer center section. The firm edge or centermost section of the box spring, according to the practice of this invention, is imparted by a novel formed wire spring having multiple torsion bar sections formed therein. This novel torsion bar containing formed wire spring though is one which is much less expensively produced and manufactured than prior art torsion bar formed springs which have heretofore characterized the prior art.

The formed wire springs manufactured in accordance with the practice of this invention are formed from conventional sinuous wire strips of the type having oppositely facing edge loops interconnected by straight torsion bar sections. According to the practice of this invention, these strips are bent into a U configuration having parallel vertical legs interconnected by a flat bottom section. The upper free ends of the vertical legs of the sinuous spring strips are, according to the practice of this invention, attached to the wire grid and the flat bottom of the strip is connected to the rectangular base frame of the box spring assembly. Thus, the sinuous wire springs provide a resilient support for the load bearing top wire grid of the box spring.

According to the practice of this invention, these sinuous wire springs are selectively positioned within the spring assembly so as to generate the desired firmness at selected locations within the assembly.

Sinuous wire spring strips are very commonly used to form resilient load supporting portions of furniture seats. In fact, very nearly all automobile seats incorporate sinuous spring strips as the resilient load portion of both the seat and the backrest of the seat assembly. Consequently, the equipment for manufacturing sinuous wire spring strips is very highly developed and such springs may therefore be very economically manufactured. This invention takes advantage of the technology for inexpensively manufacturing sinuous wire spring strips to reduce or minimize the cost of box spring assemblies by utilizing formed wire springs manufactured from sinuous wire spring strips for at least a portion of the resilient load supporting elements of the box spring.

Sinuous wire spring strips have in the past been utilized to provide edge support for a mattress or box spring. Examples of such edge supported sinuous wire springs may be found in U.S. Pat. Nos. 2,105,115; 2,826,768; and 2,798,233. To my knowledge though, sinuous wire spring strips have never been formed into generally U-shaped wire springs for prividing the resilient support between a top wire grid and a bottom frame of a box spring.

The primary advantage of this invention is that it enables a box spring to be manufactured substantially less expensively than prior art formed wire box springs while still retaining many of the advantageous characteristics of those prior art formed wire box springs.

These and other objects and advantages of the present invention will be more readily apparent from the following description of the drawings, in which.

Figure 1:
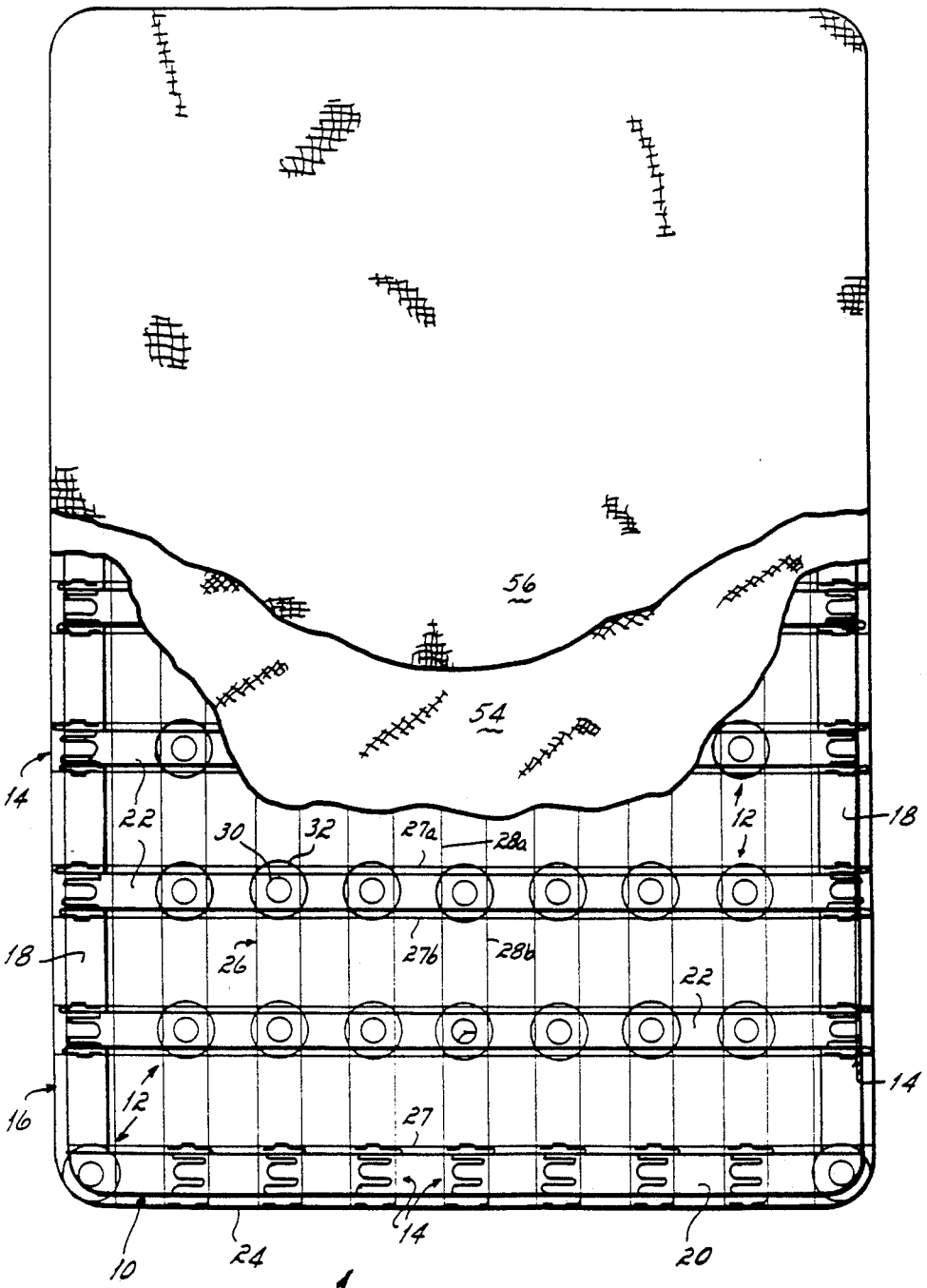
FIG. 1 is a top plan view partially broken away of a box spring assembly incorporating the invention of this application.
Figure 2:
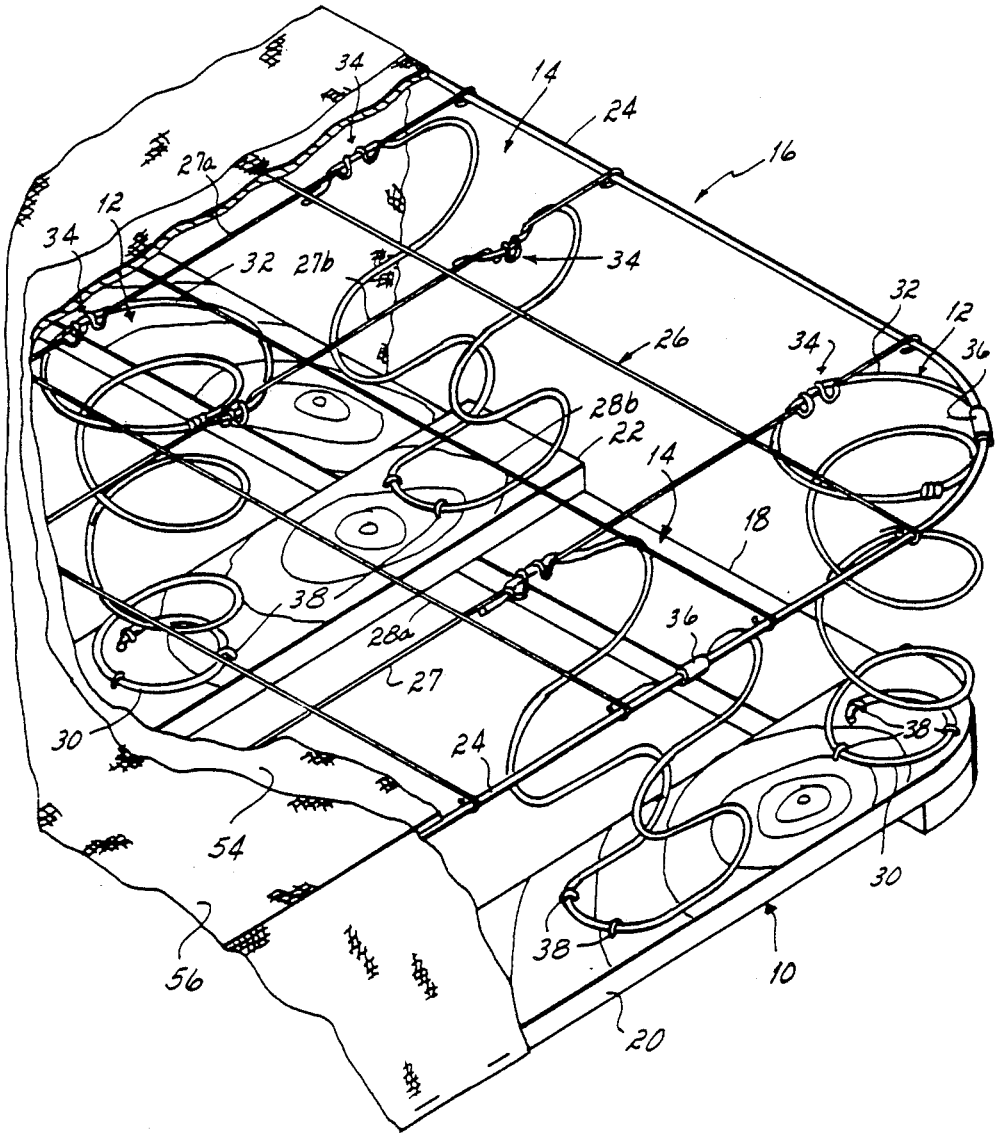
FIG. 2 is a perspective view of one corner portion of the box spring assembly of FIG. 1.
Figure 3:
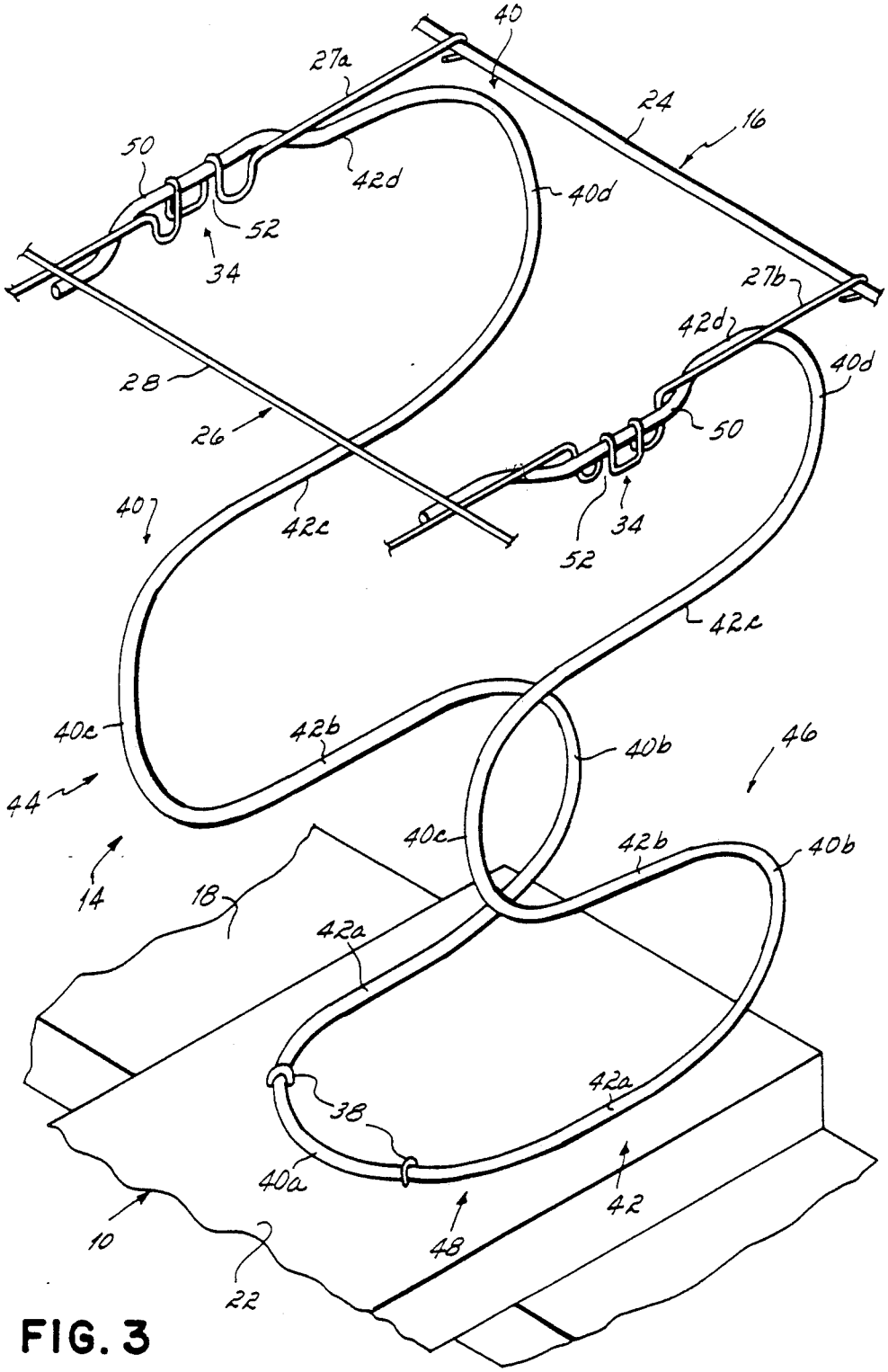
FIG. 3 is an enlarged perpective view of one corner portion of the box spring assembly of FIG. 2.

With reference first to FIGS. 1–3, it will be seen that the box spring assembly 5 of this invention comprises a wooden base frame 10 upon the top of which there is mounted a plurality of coil springs 12 and sinuous wire springs 14 for supporting a top wire grid 16. The top wire grid is intended to resiliently support a mattress as is conventional in the bedding industry.

The base frame 10 is rectangular in configuration and comprises a pair of longitudinally extending side boards 18, as well as a pair of transversely extending end boards 20 nailed or otherwise secured to the top of the side boards 18. Additionally, there are a plurality of wooden slats 22 which extend transversely across the rectangular base between the side boards 18. These slats are also nailed or otherwise fixedly secured to the top of the side boards 18.

The top wire grid 16 comprises a border wire 24 and a welded wire grid 26. The border wire 24 is formed into a rectangular configuration and overlies the peripheral edge of the rectangular base frame. The welded wire grid 16 is secured to and located in the plane of the border wire 24, the grid and border wire defining the top plane of the box spring assembly. The welded wire grid comprises a plurality of pairs 27*a*, 27*b* of transverse wires and a plurality of pairs 28*a* and 28*b* of longitudinal wires, which wires all extend between opposite sides and ends of the rectangular border wire 24. These pairs 27, 28 of grid wires are adapted to overlie and cooperate with the rows and columns of coil springs 12 and sinuous spring modules 14 so as to secure the top of those springs 12 and 14 against lateral or longitudinal displacement.

The ends of all the grid wires 27, 28 are hooked around the border wire and are preferably welded to the border wire. The intersections or cross-over points of the transverse wires 27 and the longitudinal wires 28 are welded together, thereby providing an integral welded wire grid. In manufacture, the border wire 24 and the welded wire grid 26 are all preformed into a welded top wire grid sub-assembly 16.

The coil springs 12 utilized in the box spring assembly 5 of this invention are all conventional and are of the single cone type. These single cone coil springs 12 all have the small end 30 fixedly attached to the top of one of the slats 22 or the end boards 20 and have the top coil 32 secured to the welded wire grid. The coil springs 12 are all vertically positioned within the assembly, i.e., the axis of each coil spring is oriented perpendicular to the parallel top and bottom planes of the box spring assembly. The top loop 32 of each coil spring 12 is fixed to the wire grid by hooks 34 formed in the transverse wires 27 of the wire grid 16. Each transverse wire 27 of each pair of transverse wires (each such pair serving a row of coil springs in the box spring assembly) is provided with a plurality of double reversely bent hooks 34 preformed into that transverse wire of the welded wire grid. Each hook 34 is formed as an open U-shaped element which opens downwardly so that the grid 16 may be placed over the coil springs with each top loop of each of the coil springs located in two such hooks. The open portion of each U-shaped configured hook is then bent or crimped to a closed condition so as to lock the coil springs top loop 32 within the U-shaped section of the hooks 34 of the transverse wires, i.e., so as to interconnect the coil springs with the top wire grid. Thus, each coil spring is affixed only to the transverse grid wires of the welded wire grid and not to the longitudinal grid wires which overlie, but are not secured to, the top loop of the coil springs.

At the corners of the box spring assembly there are also single cone coil springs 12 which interconnect the wooden frame to the wire grid. These corner coil springs are connected by hooks 34 to one transverse wire of the top wire grid and are connected by a conventional sheet metal clips 36 to the border wire. The small diameter bottom coil of each of these corner coil springs is connected to the top of the end boards 20 by conventional staples 38.

The outer edge of the top wire grid 16 is connected to the wooden frame—except at the corners by the sinuous wire springs 14. With reference to FIGS. 2 and 3, it will be seen that each of these sinuous wire springs 14 comprises a sinuous wire spring strip made from wire bent back and forth upon itself into a conventional sinuous form so as to have oppositely facing edge loops 40 interconnected by straight torsion bar sections 42. According to the practice of this invention, each of these sinuous spring strips is formed into a generally U-shaped configuration having substantially vertical legs 44, 46 interconnected at the bottom by a substantially flat bottom section 48. The flat bottom section of each spring comprises a single edge loop 40*a* and a pair of straight torsion bar sections 42*a* connected to the opposite ends of the edge loop 40*a*. The ends of these two straight torsion bar sections 42*a* extend from the opposite ends of the edge loop 40*a* and are connected to the vertical legs 44, 46 of the spring.

Each vertical leg comprises three edge loops 40*b*, 40*c* and 40*d* interconnected by a pair of straight torsion bar sections 42*b*, 42*c*. The topmost edge loop 40*d* in turn is connected to a free end torsion bar 42*d* which is connected to the top wire grid 16.

In order to connect the top of each of the sinuous wire springs to the top grid, the free end torsion bars 42*d* of each sinuous wire spring 14 have a horizontal offset 50 formed therein. This offset 50 is located in the horizontal plane of the free end torsion bars of the sinuous wire springs and is received within U-shaped recesses 52 formed by the hooks 34 of the transverse wires of the top grid. The connection is such that the transverse wires 27 of the grid overlie the ends of the offset portions of the free end torsion bars 42*d* of the sinuous wire springs in addition to having the center sections of the offsets received within the U-shaped recesses 52 of the hooks 34. When the U-shaped recesses 52 are crimped closed, after receipt of the end torsion bars 42*d* therein, the sinuous wire springs are securely fastened to the wire grid.

With reference now to FIG. 2, it will be seen that the sinuous wire springs 14 located over the end boards 20 of the base frame 10, have only one free end torsion bar 42*d* connected to a transverse wire 27 of the top grid, the other free end torsion bar 42 being connected to the border wire by a sheet metal clip 36. Those sinuous wire springs which are mounted over the side boards 18 though have both free end torsion bars 42*d* mounted within a hook 34 of the transverse wires 26.

All of the sinuous wire springs 14 are connected either to the top of the end boards 20 or to the top of the slats 22 by having the flat bottom section 48, and particularly the edge loop 40*a* of that section, stapled by conventional wire staples 38 to the top of the end boards or to the top of the slats 22.

In practice, the box spring of FIGS. 1–3 is assembled by first nailing the end boards 20 to the tops of the side boards 18 and by nailing the slats 22 to the tops of these same side boards. The small diameter end loops of the coil springs 12 are then stapled either to the tops of the slats 22 or, in the case of the corner coils, to the top of the end boards 20. The bottom flat sections of the sinuous wire springs 14 are also stapled to the tops of the end boards 20 and the ends of the slats 22. The preassembled top wire grid 16 is then fitted over the top of the assembled wooden frame and springs so as to position the top loops of the coil springs 12 and the free end torsion bars of the sinuous wire springs 14 within the U-shaped recesses 52 of the hooks 34 in the transverse wires 27 of the grid. The hooks are then crimped shut so as to secure the wire grid to the top loops of the coil springs and to the free ends of the sinuous wire springs. The border wire is then connected by conventional clips 36 to the adjacent free end torsion bars 42*d* of the endmost sinuous wire springs and at the corners to the corner coil springs. To complete the box spring assembly, a conventional fabric pad 54 is overlaid over the top of the welded wire grid and the complete assembly, including the rectangular wooden frame, the springs, the top wire grid, and the fabric pad are enclosed within a conventional upholstery covering 56.

Figure 4:
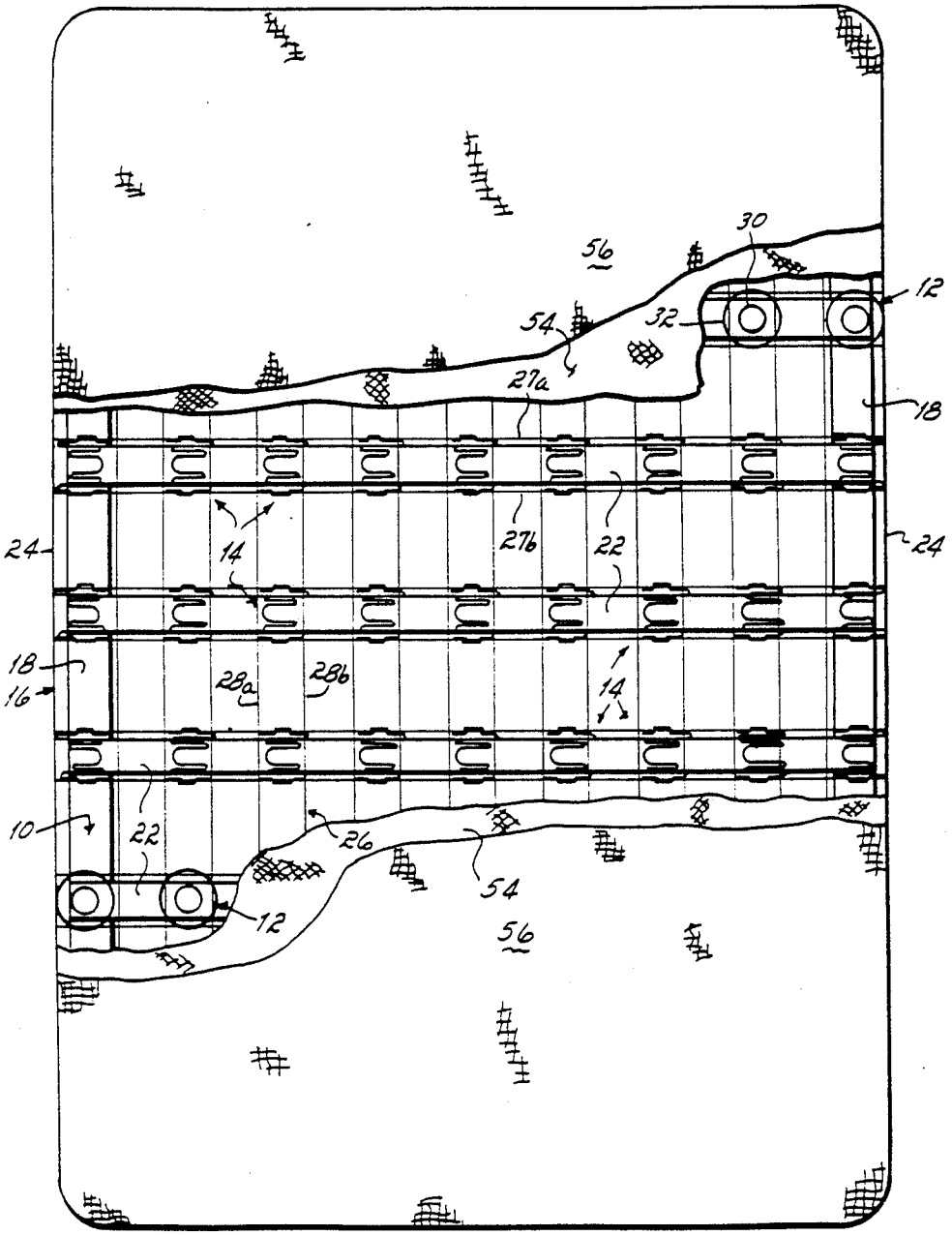
FIG. 4 is a top plan view partially broken away of a second modification of box spring assembly incorporatin the invention of this application.

With reference now to FIG. 4, there is illustrated a second embodiment 6 of the box spring incorporating the invention of this application. This embodiment utilizes the same sinuous wire springs 14 and coil springs 12 to form a box spring assembly as are utilized in the embodiment of FIGS. 1–3. The difference between the two is that in this second embodiment, the sinuous wire springs 14 are positioned over the centermost slats of the box spring assembly, rather than about the periphery of the assembly. By so positioning the sinuous wire springs, which are vertically firmer than the coil springs, the centermost section of the box spring, which bears the most weight, is made more firm than the end sections which support the head and legs of a person lying atop a mattress positioned above the box spring.

This FIG. 4 embodiment utilizes the same frame as is employed in the embodiment of FIG. 1. It also utilizes the same top wire grid as the box spring of FIG. 1. In this embodiment, as in the FIG. 1 embodiment, the free end torsion bars 42d of the sinuous wire springs are connected to the top wire grid by having offset sections 50 of the free end torsion bars received within U-shaped hooks 34 of the transverse wires of the top wire grid. The tops of the coil springs in this embodiment are also secured to the top wire grid by having the top coils 32 received within hooks 34 of transverse wires 27 of the grid, and in this embodiment, as is the embodiment of FIGS. 1–3, the flat bottom section of the torsion bar springs are secured to the top of the slats of the frame by conventional staples.

The box spring of the embodiment of FIG. 4 is assembled in the same manner as the box spring assembly of FIG. 1. That is, the wooden base frame is first assembled by nailing the end boards of the frame to the top of the side boards and by nailing the slats to the top of the same side boards. The bottom loops of the coil springs and the bottom flat sections of the sinuous wire springs are then stapled to the tops of the slats and the top of the boards of the frame. The preassembled top wire grid is then fitted over the top loops of the coil springs and the free end torsion bars of the torsion bar springs so as to position the offset positions 50 of the sinuous wire springs within the U-shaped recesses of the hooks 34 in the transverse wires 27 of the grid. Similarly, the top loops of the coil springs are received within the U-shaped recesses of the hooks 34 of the grid and the recesses are crimped closed over the top loops of the coil springs and the free end torsion bars 42*d* of the sinuous wire springs 14. A conventional fabric pad is then placed over the top of the wire grid and the complete assembly enclosed within a conventional upholstered covering material.

While I have described only two preferred embodiments of my invention, persons skilled in this art will appreciate changes and modifications which may be made without departing from the spirit of my invention. Therefore, I do not intend to be limited except by the scope of the following appended claims:

I claim:

1. A bedding foundation box spring comprising, a bottom, substantially rectangular, base frame having side and end members and slats extending between said side members, a substantially planar rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being welded together at their intersections, said first and second sets of wires being fixedly connected to said border wire, a plurality of coil springs interconnecting said bottom frame and said top grid, a plurality of sinuous wire springs interconnecting said base frame and said wire grid, said sinuous wire springs each comprising a sinuous spring strip made from wire bent back and forth to have oppositely facing edge loops interconnected by straight torsion bar sections, each of said strips being formed into a generally U-shaped configuration having substantially vertical legs interconnected by a substantially flat bottom section, said flat bottom section of each of said sinuous wire springs being fixedly secured to said base frame and the upper ends of said vertical legs of each of said sinuous springs being fixedly secured to said top wire grid, each of said vertical legs of each of said U-shaped sinuous wire springs consisting of three edge loops interconnected by a pair of straight torsion bars, the topmost one of the edge loops being connected to a third free end straight torsion bar, and said flat bottom section of each of said U-shaped sinuous wire springs consisting of a single edge loop and a pair of straight torsion bars connected to opposite ends of said single edge loop, a fabric pad overlying said top wire grid, and an upholstered covering surrounding said base frame, wire grid, border wire, sinuous wire springs, and said fabric pad.

2. The box spring of claim 1 wherein the coil springs are each generally conical in configuration and have their small ends attached to said bottom frame and their larger ends attached to said wire grid.

3. The box spring assembly of claim 1 wherein said slate extend transversely between said side members, said bottom section of said sinuous wire springs being attached to the top of said slats in the longitudinal center section of said box spring assembly so as to provide center firmness in the center section of said spring assembly.

4. The box spring of claim 1 wherein said sinuous wire springs are mounted above said side and end members of said bottom frame.

5. A bedding foundation box spring assembly comprising, a bottom, substantially rectangular, base frame having side and end members, a substantially planar rectangular top wire grid, said grid comprising a border wire and first and second sets of wires, said first set of wires comprising a plurality of longitudinally extending, spaced, parallel wires, said second set of wires comprising a plurality of transversely extending, spaced, parallel wires, the ends of both said first and second sets of wires being fixedly connected to said border wire, a plurality of coil springs interconnecting said base frame and said top wire grid, a plurality of sinuous wire springs interconnecting said base frame and said wire grid, said sinuous wire springs each comprising a sinuous spring strip made from wire bent back and forth to have oppositely facing edge loops interconnected by straight torsion bar sections, said strip being formed into a generally U-shaped configuration having substantially vertical legs interconnected by a flat bottom section, said flat bottom section of each of said sinuous wire springs being fixedly secured to said base frame and the upper ends of said vertical legs of each of said sinuous springs being fixedly secured to said top wire grid, and each of said vertical legs of each of said U-shaped sinuous wire springs consisting of three edge loops interconnected by a pair of straight torsion bars, the topmost one of the edge loops being connected to a third free end straight torsion bar, and said flat bottom section of each of said U-shaped sinuous wire springs consisting of a single edge loop and a pair of straight torsion bars connected to opposite ends of said single edge loop.

6. The box spring assembly of claim 5 wherein each of said free end torsion bars of said sinuous springs has an offset portion formed therein, and said offset portions of said free end torsion bars being fixedly secured to said wires of said wire grid.

7. The box spring assembly of claim 6 wherein said offset portion of at least some of said free end torsion bars are received within U-shaped recesses formed in said wires of said wire grid and are secured within said recesses by having said recesses crimped closed.

8. The box spring assembly of claim 5 wherein said sinuous wire springs are mounted above said side and end members of said bottom frame so as to provide increased edge firmness about the periphery of said spring assembly.

9. The box spring assembly of claim 5 wherein said base frame comprises a plurality of transverse slats extending between said side members, said bottom section of said sinuous wire springs being attached to the top of the slats in the longitudinal center section of said box spring assembly so as to provide center firmness in the center section of said spring assembly.

10. A bedding foundation box spring comprising, a bottom, substantially rectangular, base frame having side and end members and slats extending between said side members, a substantially planar rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being welded together at their intersections, said first and second sets of wires being fixedly connected to said border wires, a plurality of sinuous wire springs interconnecting said base frame and said wire grid, said sinuous wire springs each comprising a sinuous spring strip made from wire bent back and forth to have oppositely facing edge loops interconnected by straight torsion bar sections, each of said strips being formed into a generally U-shaped configuration having substantially vertical legs interconnected by a substantially flat bottom section, said flat bottom section of each of said sinuous wire springs being fixedly secured to said base frame and the upper ends of said vertical legs of each of said sinuous springs being fixedly secured to said top wire grid, and each of said vertical legs of each of said U-shaped sinuous wire springs consisting of three edge loops interconnected by a pair of straight torsion bars, the topmost one of the edge loops being connected to a third free end straight torsion bar, and said flat bottom section of each of said U-shaped sinuous wire springs consisting of a single edge loop and a pair of straight torsion bars connected to opposite ends of said single edge loop.

11. The box spring assembly of claim 10 wherein each of said free end torsion bars of said sinuous springs has an offset portion formed therein, and said offset portions of said free end torsion bars being fixedly secured to said wires of said wire grid.

12. The box spring assembly of claim 11 wherein said offset portion of at least some of said free end torsion bars are received within U-shaped recesses formed in said wires of said wire grid and are secured within said recesses by having said recesses crimped closed.

13. The box spring assembly of claim 10 wherein said sinuous wire springs are mounted above said side and end members of said bottom frame so as to provide increased edge firmness about the periphery of said spring assembly.

14. The box spring assembly of claim 10 wherein said base frame comprises a plurality of transverse slats extending between said side members, said bottom section of said sinuous wire springs being attached to the top of the slats in the longitudinal center section of said box spring assembly so as to provide center firmness in the center section of said spring assembly.

15. A sinuous wire spring for use in a bedding foundation having a bottom, substantially rectangular, base frame and a substantially planar rectangular top wire grid, said sinuous wire spring comprising a sinuous spring strip made from wire bent back and forth to have oppositely facing edge loops interconnected by straight torsion bar sections, said strip being formed into a generally U-shaped configuration having substantially parallel vertical legs interconnected by a flat section extending substantially perpendicular to said vertical legs, said flat section of each of said sinuous wire springs being adapted to be fixedly secured to one of said base frame and wire grid, the ends of said vertical legs remote from said flat section being adapted to be fixedly secured to the other of said base frame and grid, and each of said vertical legs of each of said U-shaped sinuous wire springs consisting of three edge loops interconnected by a pair of straight torsion bars, the endmost one of the edge loops remote from said flat section being connected to a third free end straight torsion bar, and said flat bottom section of each of said U-shaped sinuous wire springs consisting of a single edge loop and a pair of straight torsion bars connected to opposite ends of said single edge loop.

* * * * *